US011293695B2

(12) United States Patent
Fernandez De Retana Arregui et al.

(10) Patent No.: US 11,293,695 B2
(45) Date of Patent: Apr. 5, 2022

(54) CONVEYING THROUGH FURNACES

(71) Applicants: AUTOTECH ENGINEERING S.L., Amorebieta-Etxano (ES); GHI HORNOS INDUSTRIALES S.L., Galdakao-Bizkaia (ES)

(72) Inventors: Eduardo Fernandez De Retana Arregui, Galdakao-Bizkaia (ES); Diego Angulo Angulo, Galdakao-Bizkaia (ES)

(73) Assignee: AUTOTECH ENGINEERING S.L., Amorebieta-Etxano (ES)

( * ) Notice: Subject to any disclaimer, the term of this patent is extended or adjusted under 35 U.S.C. 154(b) by 371 days.

(21) Appl. No.: 16/320,884

(22) PCT Filed: Jul. 27, 2017

(86) PCT No.: PCT/EP2017/068954
§ 371 (c)(1),
(2) Date: Jan. 25, 2019

(87) PCT Pub. No.: WO2018/019920
PCT Pub. Date: Feb. 1, 2018

(65) Prior Publication Data

US 2019/0162472 A1 May 30, 2019

(30) Foreign Application Priority Data

Jul. 28, 2016 (EP) ..... 16382369

(51) Int. Cl.
*F27B 9/20* (2006.01)
*F27D 3/12* (2006.01)

(52) U.S. Cl.
CPC ..... *F27B 9/202* (2013.01); *F27B 9/201* (2013.01); *F27D 3/12* (2013.01)

(58) Field of Classification Search
CPC ..... F27D 3/12; F27B 9/202
See application file for complete search history.

(56) References Cited

U.S. PATENT DOCUMENTS 2,056,070 A * 9/1936 Menough ..... F27B 9/208 432/244
3,471,134 A * 10/1969 Cone ..... F27B 9/205 432/74

(Continued)

FOREIGN PATENT DOCUMENTS

DE 2117148 A1 10/1972
DE 3425165 1/1986
DE 102011011258 A1 5/2012

OTHER PUBLICATIONS

Extended European Search Report dated Jan. 20, 2017, for European Application No. EP16382369.3, 7 pages.

(Continued)

*Primary Examiner* — Steven S Anderson, II
(74) *Attorney, Agent, or Firm* — Squire Patton Boggs (US) LLP

(57) ABSTRACT

A conveyor unit for moving products in a conveying direction is disclosed. The unit comprises first beams extending along the conveying direction substantially parallel to each other. The first beams are slidably mounted on rollers and are displaceable in a back-and-forth reciprocating motion along the conveying direction between an upstream position and a downstream position. The unit further comprises second beams extending along the conveying direction and arranged interleaved with the first beams. The second beams are configured to be displaceable in an up-and-down reciprocating motion between a lower vertical position and an upper vertical position along a vertical direction that is defined in a plane substantially perpendicular to a plane of the conveying direction, wherein an upper working surface of the first beams is positioned along the vertical direction, between the lower vertical position and the upper vertical position.

13 Claims, 5 Drawing Sheets

(56) References Cited

U.S. PATENT DOCUMENTS

| | | | | | |
|---|---|---|---|---|---|
| 3,606,280 | A | * | 9/1971 | Gentry | F27B 9/206<br>432/121 |
| 3,887,064 | A | | 6/1975 | Brockmann | |
| 4,919,254 | A | * | 4/1990 | Bricmont | B65G 25/02<br>198/751 |
| 4,975,048 | A | * | 12/1990 | Yoneda | F27B 9/202<br>414/156 |
| 5,334,014 | A | * | 8/1994 | Orbeck | F27B 9/203<br>432/121 |
| 2008/0164123 | A1 | * | 7/2008 | Noe | B65G 25/02<br>198/463.3 |

OTHER PUBLICATIONS

International Search Report and Written Opinion for International PCT application No. PCT/EP2017/068954 dated Oct. 20, 2017, 10 pages.

* cited by examiner

CONVEYING THROUGH FURNACES

The present disclosure relates to conveyor systems for transporting products through high temperature furnaces, particularly furnaces used in production lines for hot forming structural components of vehicles.

BACKGROUND

Furnaces in which a charge introduced at one end, is moved through the furnace and is discharged at the other end are known as continuous or semi-continuous furnaces or systems. Typical applications for continuous or semi-continuous systems are heat treatments of e.g. aluminium ingots, metal billets, steel coils, bars or blanks among others.

The continuous furnace is to be understood as a type of reheating furnace in which the charge introduced at one end moves continuously through the furnace and is discharged at the other end. It is usually used to assure a timely feeding of a subsequent continuous process.

The semi-continuous furnace is a particular case of continuous furnace in which once the whole furnace is full with the constantly moving charge such a continuous movement is stopped so the charge may be left inside the furnace a predefined period of time. It is usually used when batches of heated charge/products are needed.

In the automotive industry, the demand for weight reduction has led to the development and implementation of lightweight materials, manufacturing processes and tools. The growing concern for occupant safety also leads to the adoption of materials which improve the integrity of the vehicle during a crash while also improving the energy absorption. In that sense, vehicle parts made of high-strength and ultra-high-strength steel are often employed in order to satisfy criteria for lightweight construction.

For example, a process known as Hot Forming Die Quenching (HFDQ) uses boron steel sheets to create stamped components with Ultra High Strength Steel (UHSS) properties, with tensile strengths of at least 1.000 MPa, preferably approximately 1.500 MPa or up to 2.000 MPa or more. The increase in strength allows for a thinner gauge material to be used, which results in a weight savings over conventionally cold stamped mild steel components.

In such methods, the blanks to be heated may be made of steel, particularly an Ultra High Strength Steel (UHSS). In general terms, steel blanks may comprise a steel substrate and a metal coating layer. Examples of metal coating layers include aluminium or an aluminium alloy or zinc or a zinc alloy. Examples of steel substrates or steel blanks Include boron steel.

An example of boron steel used in the automotive is 22MnB5 steel. The composition of 22MnB5 may be summarized below in weight percentages (rest is iron (Fe) and impurities):

| C | Si | Mn | P | S |
|---|---|---|---|---|
| 0.20-0.25 | 0.15-0.35 | 1.10-1.35 | <0.025 | <0.008 |
| Cr | Ti | B | N | |
| 0.15-0.30 | 0.02-0.05 | 0.002-0.004 | <0.009 | |

Several 22MnB5 steels are commercially available having a similar chemical composition. However, the exact amount of each of the components of a 22MnB5 steel may vary slightly from one manufacturer to another. Usibor® 1500P is an example of a commercially available 22MnB5 steel manufactured by Arcelor.

The composition of Usibor® may be summarized below in weight percentages (rest is iron (Fe) and impurities):

| C | Si | Mn | P | S | Cr | Ti | B | N |
|---|---|---|---|---|---|---|---|---|
| 0.24 | 0.27 | 1.14 | 0.015 | 0.001 | 0.17 | 0.036 | 0.003 | 0.004 |

In other examples, 22MnB5 steels may contain approximately 0.23% C, 0.22% Si, and 0.16% Cr. The material may further comprise Mn, Al, Ti, B, N, Ni in different proportions.

Various other steel compositions of UHSS may also be used in the automotive industry. Particularly, the steel compositions described in EP2735620A1 may be considered suitable. Specific reference may be had to table 1 and paragraphs 0016-0021 of EP2735620A1, and to the considerations of paragraphs 0067-0079.

In some examples, the UHSS blanks may contain approximately 0.22% C, 1.2% Si, and 2.2% Mn.

Steel of any of these compositions (both 22MnB5 steel such as e.g. Usibor® and the other compositions mentioned or referred to before) may be supplied with a coating in order to prevent corrosion and oxidation damage. This coating may be e.g. an aluminium-silicon (AlSi) coating or a coating mainly comprising zinc or a zinc alloy.

Usibor® 1500P is supplied in ferritic-perlitic phase. It is a fine grain structure distributed in a homogenous pattern. The mechanical properties are related to this structure. After heating, a hot stamping process, and subsequent quenching, a martensite microstructure is created. As a result, maximal strength and yield strength increase noticeably. Similar processes may be applicable to any other steel composition.

It has been found that such 22MnB5 steels may have an Ac3 point at or near 880° C. Others UHSS may have Ac3 point around 800° C. or higher.

Steel blanks may thus be heated in a furnace so as to reach a temperature higher than Ac3. Thus, the heating may be performed to a temperature above 880° C.

In order to follow a continuous hot forming process, the blanks need to arrive at the press in a uniform time interval. This way it is desirable that heating of the blanks up to a temperature higher than austenization (Ac3), i.e. approximately above 880° C. also follows a continuous process. Heating furnaces configured as continuous furnaces are thus being used for heating blanks up to austenization in order to assure a timely feeding into the press.

Known continuous furnaces comprise, for example, roller conveying systems in which the blanks are conveyed on top of rollers. The forward movement of the blanks is provided by driving the rollers. These systems involve rather expensive and cumbersome maintenance tasks, as the rollers can be easily contaminated. Other known systems use e.g. "walking beams", in which the beams make a somewhat cyclical movement. These systems Involve rather large and long positioning systems.

In a conventional "walking beams" conveying system, the driving mechanism for transmitting the movement to the "walking beams" is normally placed under the furnace. Thus, it is required to have some kind of openings in the bottom of the furnace in order to allow the transmission of the movement from the driving mechanism to the walking beams. Typically, the openings required for transmitting the back-and-forth motion to the horizontal moving beams are a longitudinal openings, which makes it difficult to seal the furnace from the outer atmosphere. The openings required for transmitting the up-and-down motion to the vertical moving beams are normally smaller than the longitudinal ones.

Document DE102010019215 discloses conveyor systems for continuous furnaces that promote the use of chains for delivery of the conveyed products. However, in circumstances, maintaining a uniform tension in these chains may be inefficient thus leading to less resistant systems. This is increasingly challenging as the furnaces become longer. In examples, long furnaces may be furnaces having a length greater than approximately 35 meters.

It is an object of the present disclosure to provide enhanced conveyor systems for moving to-be-processed products inside high temperature furnaces.

Throughout the present description and claims, "high temperature" may depend on the process needing heating. For example, for hot stamping processes "high temperature" should be understood as temperatures above austenization temperature, in particular above Ac3. When steel blanks are heated inside the furnaces, e.g. for hot stamping steel blanks, depending on the composition of the blank, the high temperatures may be in a range from approximately 800° C. and up to approximately 960° C. Alternatively, for other applications such as e.g. precipitation hardening treatment of aluminium alloys, "high temperature" may be understood as temperatures ranging above approximately 200° C. In yet further examples, e.g. for homogenizing of different alloys, "high temperature" may be around approximately 500° C.

The aforementioned problems and/or challenges are not unique to the automotive industry or to the materials and processes used in that industry. Instead these challenges may be encountered in any industry wherein a product needs to be subjected to high temperature and a subsequent process uses the heated product as an input.

SUMMARY

In a first aspect, a conveyor unit for moving products in a conveying direction through a furnace is provided. The conveyor unit comprises a plurality of first elongated beams extending along the conveying direction and arranged substantially parallel to each other. The first beams are slidably mounted on rollers and are configured to be displaceable in a back-and-forth reciprocating motion along the conveying direction between an upstream (backwards) position and a downstream (forward) position. The conveyor unit further comprises a plurality of second elongated beams extending along the conveying direction and arranged interleaved with the first beams. The second beams are configured to be displaceable in an up-and-down reciprocating motion between a lower vertical position and an upper vertical position along a vertical direction. The vertical direction is defined in a plane substantially perpendicular to a plane of the conveying direction, and an upper working surface of the first beams that in use supports the products is positioned along the vertical direction, between the lower vertical position and the upper vertical position of the second beams.

According to this aspect, the provision of two different sets of beams movable in substantially perpendicular reciprocating motions in combination with the fact that a working surface of the first set of beams lies between the two end positions (upper and lower vertical position) of the second beams and with a coordination in the movement of either set of beams, allows products to be displaced along the first beams length, thus along the conveying direction. Provided the conveyor unit is arranged inside, e.g. a furnace, the products are thus able to "travel" through the furnace. Furthermore and provided after each stroke (reciprocating motion in the back and forth direction) of the first beams a new product (or products) are fed at the initial position, the products can travel through the furnace in a continuous manner.

The two sets of beams movable in substantially perpendicular motions are the plurality of first beams moveable in a back-and-forth reciprocating motion along the conveying direction and the plurality of second beams provided interleaved with the first beams and being moveable in an up-and-down reciprocating motion, i.e. in a plane substantially perpendicular to that in which the conveying direction lies.

Further in this aspect, the fact that the first beams are slidably mounted on rollers facilitates lineal displacement of the first beams from the upstream (backwards) position to the downstream (forward) position. Furthermore, in circumstances, depending on the length of the first beams the provision of rollers reduces bending of the beams.

According to this aspect, it is not required that the driving mechanism for transmitting the movement to the rollers be placed under the furnace. Therefore, there is no need to have longitudinal openings in the bottom of the furnace, thus allowing a better sealing of the furnace chamber. A good sealing of the furnace chamber permits to have a better control on the temperature of the furnace. In some examples, when the furnace chamber is property sealed, a protective atmosphere can be provided in the furnace chamber. Non-limiting examples of protective atmospheres are dried air, nitrogen and/or methane.

In a conventional "walking beam" furnace the heaters are normally arranged in the upper part of the furnace chamber, because of the presence of the longitudinal openings in the bottom of the furnace. Therefore, in the present invention, since there is no need to have the driving mechanism under the furnace, it is possible to arrange a lower heater in the lower part (or bottom) of the furnace chamber, as a complement or as an alternative to the upper heater, inasmuch as there is no need to have a longitudinal opening in the bottom of the furnace. However, it is still required to have the openings placed in the bottom of the furnace in order to transmit the up-and-down movement to the vertical moving beams, but this kind of openings are small, easy to seal and compatible with the arrangement of a heater in the bottom of the furnace.

Throughout the present description and claims, the term "upstream or backwards position" is to be understood as in or to a position within the conveying direction/flow which is closer to the entrance or charging area of the conveyor unit or the entrance of the furnace. And the term "downstream or forward position" is to be understood as in or to a position within the conveying direction/flow which is closer to the exit or discharging area of the conveyor unit or the furnace.

In some examples, the products to be conveyed may be blanks typically used in the automotive industry. In some of these cases, steel blanks may be foreseen. In more examples, aluminium ingots, metal billets, steel coils or bars, baskets or containers, or any type of charge in general, including batches of products may be foreseen.

In some examples, the second beams may further be arranged substantially parallel to each other.

In some examples, the rollers may be defined by outer protrusions or discs circumferentially provided on one or more rotatable shafts. In these cases, the shafts may be arranged substantially transversally to the first beams. This means that when a conveyor unit substantially as hereinbefore described is used e.g. inside a furnace, the shafts may be mounted inside the furnace or may remain outside the furnace while the outer protrusions/discs are at least partially inside the furnace. Mounting the shafts outside the furnace reduces potential damaging of the shaft or at least avoids the need for special and expensive materials for the shaft (e.g. ceramic or cast materials able to withstand high temperatures) as only the protrusions/discs, i.e. the rollers, are arranged inside the furnace. This is quite cost-effective in terms of material costs. In examples, the discs or outer protrusions may be mounted, welded or even integrally formed with the shaft. In some examples, each disc or outer protrusion might be mounted, welded or even integrally formed with an independent shaft.

In more examples, the rollers may be defined by the outer perimeter of rotatable shafts having a substantially uniform external diameter. In these cases, the shafts may be operatively coupled to the first beams. In these examples, when the conveyor is provided e.g. inside a furnace, the shafts may remain inside the furnace.

In some examples, the first beams may comprise an inverted U-shaped cross-section. In these cases, the rollers may fit inside the inverted U-shape. Alternatively, an H-shaped cross-section or similar may be foreseen. Fitting the rollers inside the U-shaped beams reduces contamination of the rollers by e.g. any coating or component falling from the products when e.g. the conveyor unit is arranged e.g. inside a furnace. Particularly, the products may be steel blanks having e.g. an AlSi or Zn coating.

In some examples, the rollers may be idle rollers and the movement of the first beams may be produced and controlled by e.g. a driving mechanism configured to provide the back-and-forth reciprocating motion to the first beams. Alternatively, the rollers may be coupled to a motor which provides rotary motion to one or more of the shafts to aid the back-and-forth reciprocating motion. In some of these cases, the rollers may be connected with the driving mechanism configured to provide the back-and-forth reciprocating motion to the first beams (without an additional linear drive mechanism).

In another aspect of the present Invention, there is a method of moving products in a conveying direction through the conveyor unit of the present invention. The method comprises providing the first beams in the upstream position and the second beams in the lower vertical position. The method further comprises:

a) providing one or more products on the first beams at an initial position along the conveying direction corresponding to an initial position along the first beams;
b) moving the first beams from the upstream position to the downstream position such that the products reach a first position along the conveying direction while maintaining the initial position with respect to the first beams;
c) moving the second beams from the lower vertical position to the upper vertical position such that products are supported by the second beams, at the first position along the conveying direction;
d) moving the first beams from the downstream position to the upstream position; and
e) moving the second beams from the upper vertical position to the lower vertical position such that products are supported by the first beams, at the first position along the conveying direction which corresponds to a first position along the first beams that is different than the initial position along the first beams.

In this aspect, the method provides an effective way of conveying products through a conveyor unit that may be arranged, e.g. Inside a furnace. The method is rather simple to operate as it only needs to coordinate two reciprocating movements in perpendicular planes. And it needs relatively little vertical space to operate as a first group of beams only moves longitudinally and a second group of beams only moves vertically.

In a preferred embodiment, the method of the present invention further comprises:

f) moving the first beams with the products at the first position with respect to the first beams from the upstream position to the downstream position such that the products reach a second position along the conveying direction while maintaining the first position with respect to the first beams;
g) moving the second beams from the lower vertical position to the upper vertical position such that products are supported by the second beams, at the second position along the conveying direction;
h) moving the first beams from the downstream position to the upstream position; and
i) moving the second beams from the upper vertical position to the lower vertical position such that products are supported by the first beams, at the second position along the conveying direction which corresponds to a second position along the first beams that is different than the first position along the first beams; and optionally repeating steps f) to i).

In a another preferred embodiment, the method of the present invention further comprises after step h) described above:

j) moving the second beams from the upper vertical position to the lower vertical position such that the products remain supported by the second beams, at the second position along the conveying direction; and
k) moving the first beams from the upstream position to the downstream position so as to push the products held by the second beams, from the second position along the conveying direction to a third position along the conveying direction.

In a further aspect a continuous furnace is provided. The furnace comprises a conveyor unit substantially as hereinbefore described for moving products in a conveying direction with a method substantially as hereinbefore described. In examples, the furnace may comprise two or more conveyor units substantially as hereinbefore described. In these examples, the first beams (moving horizontally) of a downstream conveyor unit at an upstream position may be partially interleaved with the second beams (moving vertically) of an upstream conveyor unit. Alternatively or additionally, the first beams (moving horizontally) of the upstream conveyor unit at a downstream position may be partially interleaved with the second beams (moving vertically) of the downstream conveyor unit.

In some examples, the first beams of two or more conveyor units may move in unison and the second beams of the two or more conveyor units may move in unison.

This way, when the products reach a downstream end of the first beams of the upstream conveyor unit, the second beams are moved from the lower vertical position to the upper vertical position, the first beams are moved from the downstream position to the upstream position and the second beams are moved back from the upper vertical position to the lower vertical position, the products are supported by the second beams of the downstream conveyor unit.

In further alternatives, the first beams of the downstream conveyor unit may be interleaved with the first beams of the upstream conveyor units. Combinations of these alternatives may also be foreseen.

The products can thus move through first beams of consecutive conveyor units thus enabling the construction of e.g. furnaces of substantially any desire length without triggering e.g. the bending resistance of the beams by adding more consecutive conveyor units substantially as hereinbefore described.

In more examples, to form a conveyor unit the first beams and/or the second beams may have the whole length of the unit. A length of conveyor unit may be defined by a length of e.g. the furnace in which the conveyor unit will be used. Alternatively, two or more first beams or second beams may be joined together, e.g. by welding, to form a longer conveyor unit.

BRIEF DESCRIPTION OF THE DRAWINGS

Non-limiting examples of the present disclosure will be described in the following with reference to the appended drawings, in which.

DETAILED DESCRIPTION OF EXAMPLES

In these figures the same reference signs have been used to designate matching elements.

Figure 1:
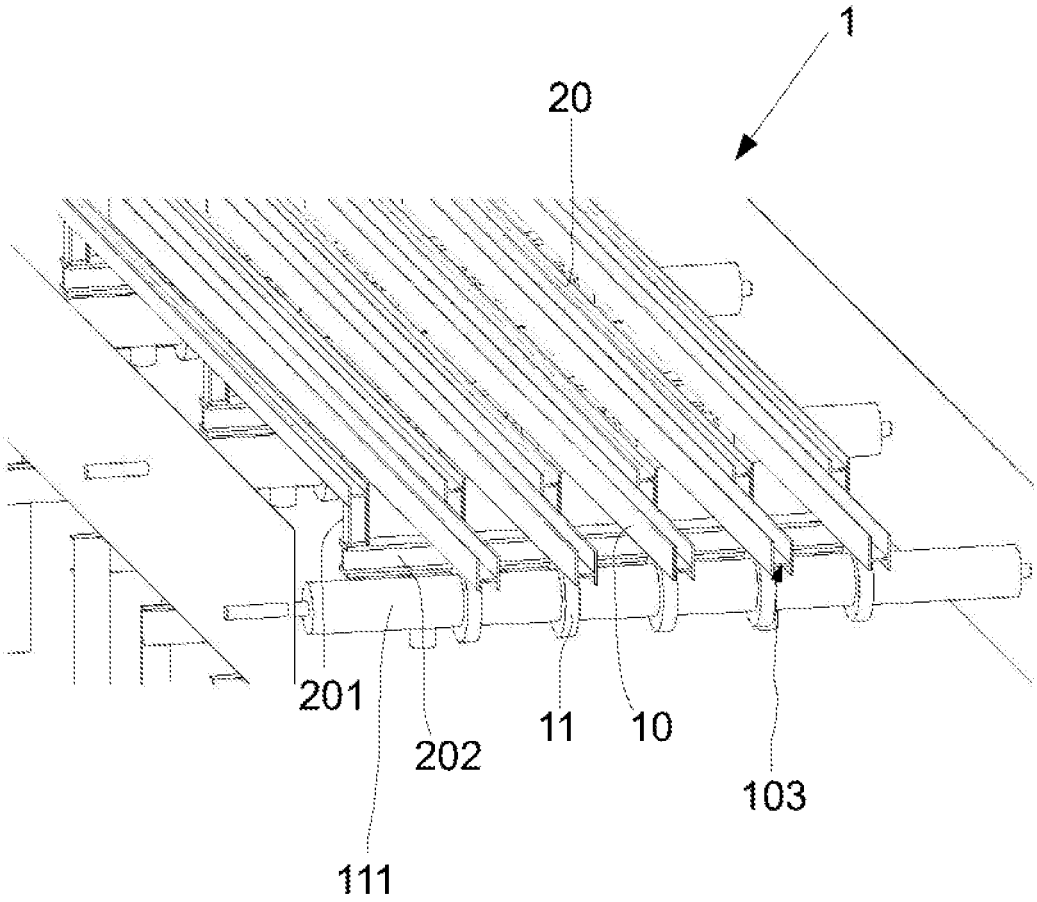
FIG. 1 shows a perspective of a conveyor unit according to an example.

FIG. 1 shows a perspective of an example of a conveyor unit 1 for moving products in a conveying direction (see arrow A in FIGS. 3*a*-3*d*). The unit 1 comprises a plurality of first beams 10 that are slidably mounted on rollers 11. In this example, five first beams are provided, however in further examples, other number of first beams may be provided.

Figure 3A:
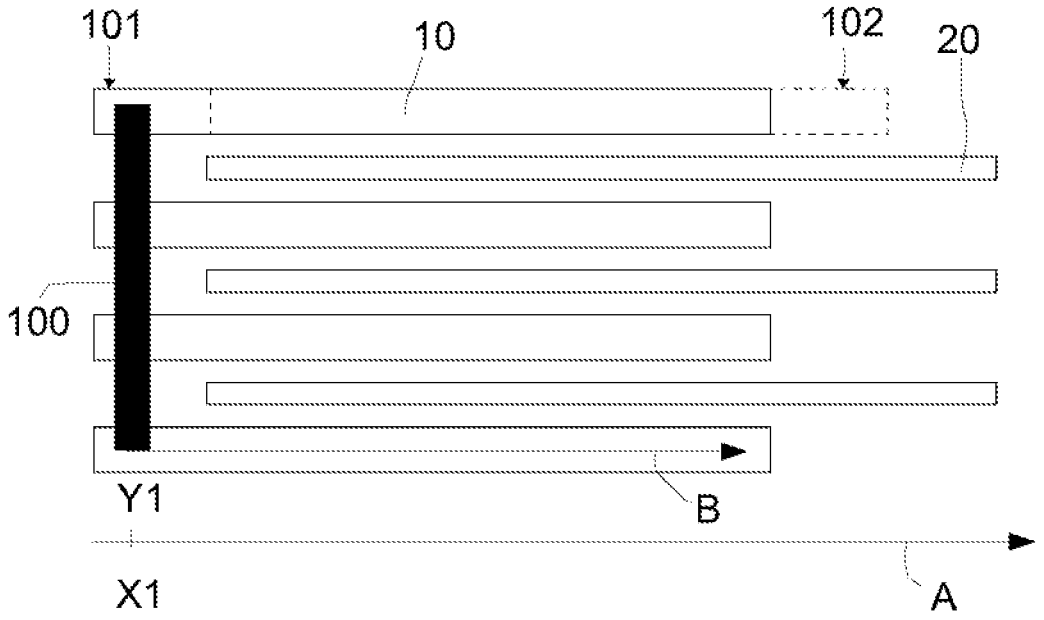
FIGS. 3*a*-3*d* schematically show a sequence of situations occurring during the performance of a method of moving products in a conveying direction through a conveyor unit substantially as hereinbefore described.

In some examples, the first beams 10 may be mounted to a frame (not shown) that may be connected to a linear driving mechanism (not shown) so as to provide the first beams 10 with a back-and-forth reciprocating motion between an upstream (backwards) position and a downstream (forward) position (see 101 and 102 in FIG. 3*a*). In examples, the driving mechanism may be any known mechanical, hydraulical or servo-mechanical mechanism providing a linear displacement. Particularly hydraulic pistons driven by a motor, e.g. an electric motor, may be foreseen.

As further shown in FIG. 1, the rollers 11 are circumferentially provided on rotatable shafts 111 e.g. as outer protrusions thereof. In examples, the rollers may be coupled or fixed to the shafts by e.g. screws or welding. Alternatively, the rollers may be machined with the shafts. In examples, the shaft may be allowed to freely rotate in a passive manner and movement of the first beams may be governed e.g. by driving mechanism configured to provide the back-and-forth reciprocating motion to the first beams. In other examples, a motor may be used to provide rotary motion to the shafts or to one or more of the shafts in order to aid the back-and-forth reciprocating motion. In some of these examples, the rollers may be connected with the driving mechanism configured to provide the back-and-forth reciprocating motion to the first beams (without an additional linear drive mechanism).

The unit 1 further comprises a plurality of second beams 20 that are arranged interleaved with the first beams 10. A further driving mechanism 21 may be foreseen to provide the second beams 20 with an up-and-down reciprocating motion between a lower vertical position and an upper vertical position (see FIGS. 2*a* and 2*b*) along a vertical direction. The vertical direction may be defined in a plane substantially perpendicular to a plane of the conveying direction.

As further shown in FIG. 1, the first beams 10 comprise an H-shaped cross-section. A lower part 103 of the H-shaped cross-section covers the rollers 111 thus reducing potential contamination of the rollers by e.g. coatings falling from the products when the conveyor unit is arranged e.g. Inside a furnace. Alternatively, the first beams may comprise an inverted U-shaped cross-section.

Figure 2A:
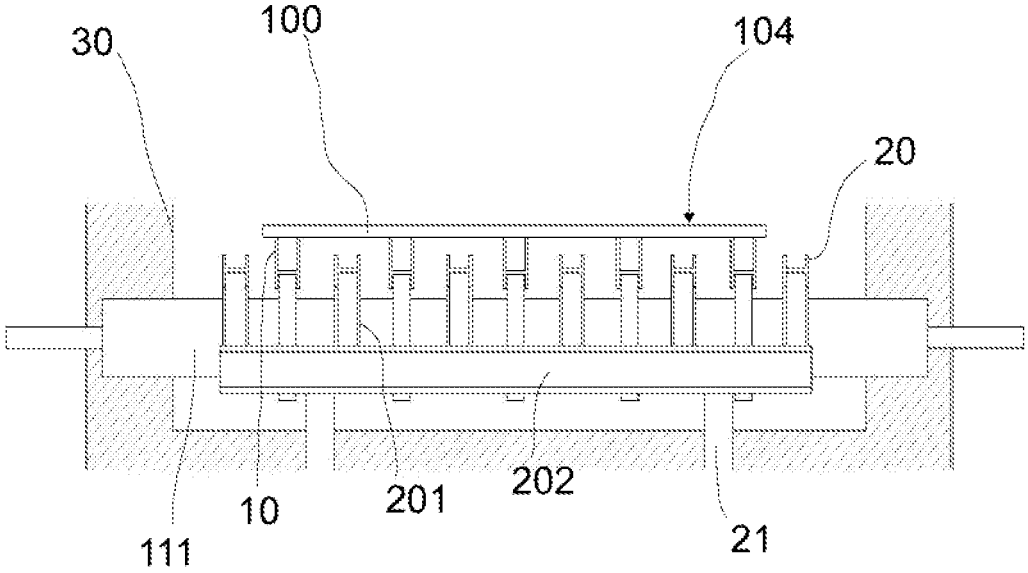
FIGS. 2*a* and 2*b* show cross-sectional views at different vertical positions of second beams of the unit of FIG. 1 arranged inside a furnace.
Figure 2B:
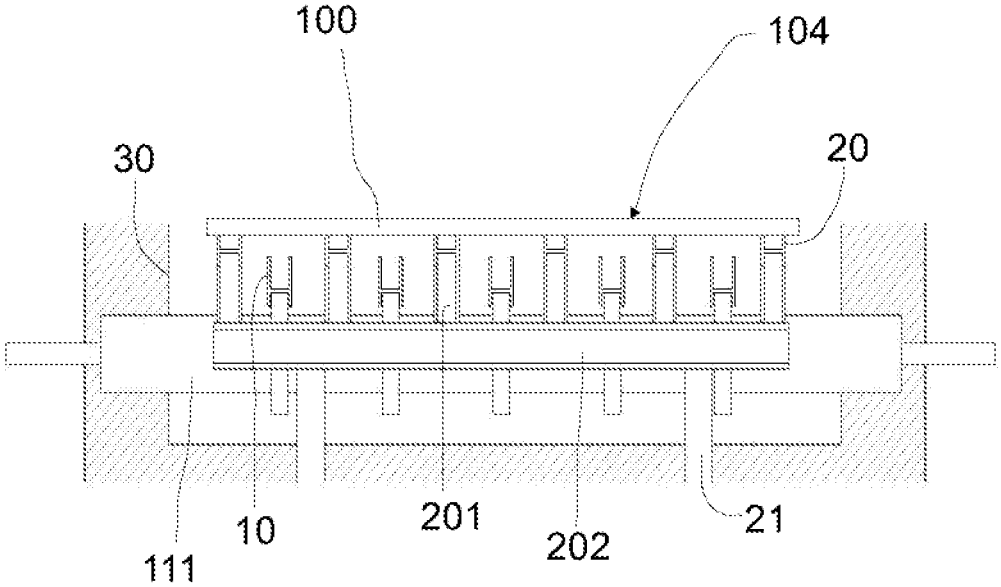

FIGS. 2*a* and 2*b* show cross-sectional views at different vertical positions of second beams of the unit of FIG. 1 arranged inside a furnace 30. In FIG. 2*a* the second beams are at the lower vertical position and in FIG. 2*b* the second beams 20 are at the upper vertical position. As further shown in these figures, a working surface 104. i.e. a surface of the first beams 10 on which a product 100 may be supported, lies between the upper vertical position and the lower vertical position.

The second beams 20 may be mounted in supports 201. In examples, T-shaped supports able to withstand two beams at the same time may be foreseen. The supports 201 may in turn be mounted to a frame 202 that may be connected to the further driving mechanism configured to provide the second beams 20 with the up-and-down reciprocating motion. In examples, the driving mechanism may be any known mechanical, hydraulical or servo-mechanical mechanism providing a linear displacement. Particularly hydraulic pistons driven by a motor, e.g. an electric motor, may be foreseen.

As further shown in FIGS. 2*a* and 2*b* the conveyor unit may be housed inside the furnace 30 leaving e.g. the driving mechanisms and the shafts 111 outside from the furnace 30. This way only the beams (first and second beams), the rollers and the supports for the second beams need to be made from e.g. refractory materials able to withstand high temperatures inside the furnace, when the conveyor unit is designed to be mounted inside a furnace. This is rather cost-effective in terms of material costs.

FIGS. 3*a*-3*d* schematically show a sequence of situations occurring during the performance of a method of moving products or batches of products such as e.g. blanks or parts in a conveying direction through a conveyor unit substantially as hereinbefore described. The method is described below with reference to the sequences of situations illustrated by FIGS. 3*a*-3*d*.

The sequence starts at FIG. 3*a* in which the first beams 10 are positioned in the upstream position 101 (the downstream position 102 of the first beams is represented in dashed lines) and the second beams 20 in the lower vertical position (see FIG. 2*a*). In these initial positions of the first and second beams, a product 100 (or alternatively a plurality of products, even a batch or products) may be provided on the first beams 10 at an initial position X1 along the conveying direction (arrow A) corresponding to an initial position Y1 along the first beams 10 (arrow B).

Figure 3B:
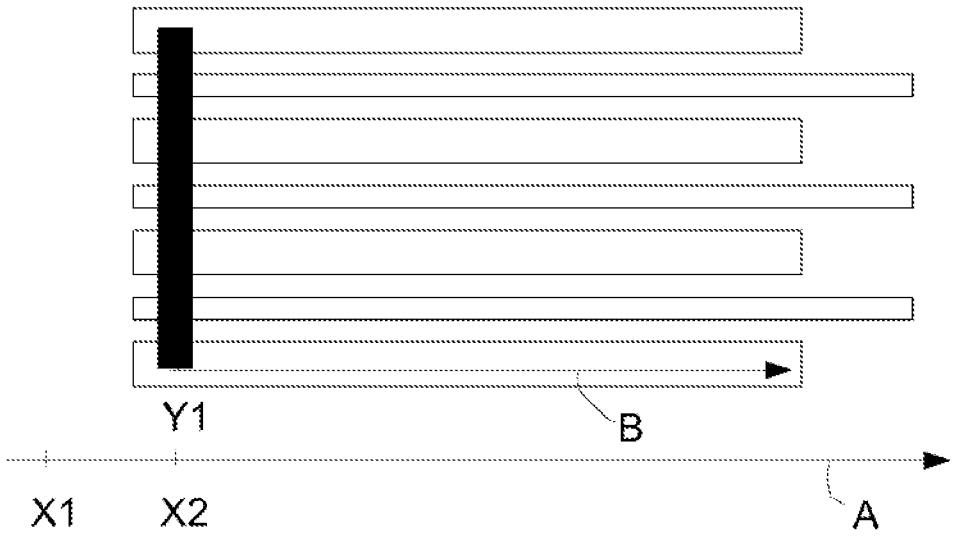

In FIG. 3*b* the first beams 10 with the product 100 are in the downstream position, i.e. the first beams have already been moved from the upstream position to the downstream position. This way, the product 100 may reach a first position X2 along the conveying direction (arrow A) while maintaining the initial position Y1 with respect to the first beams 10.

Further in FIG. 3*b*, the second beams 20 may be moved from the lower vertical position to the upper vertical position. The product 100 may thus be supported by the second beams 20, at the first position X2 along the conveying direction (arrow A).

Figure 3C:
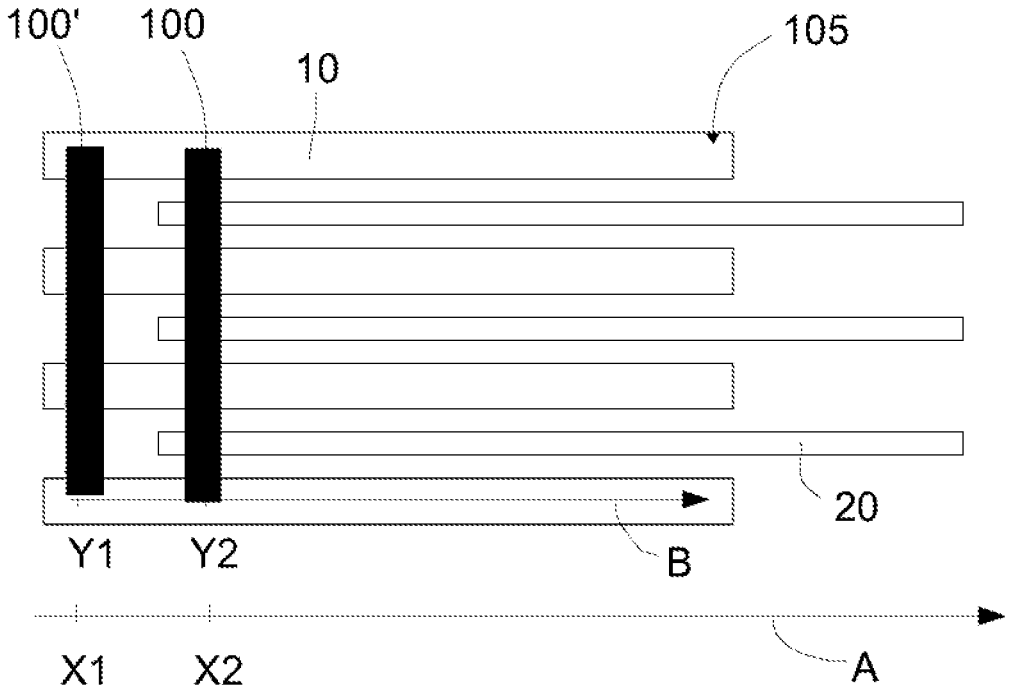

The sequence continues in FIG. 3*c* in which the first beams 10 are again in the upstream position, i.e. the first beams have already been moved back from the downstream position to the upstream position. Further in FIG. 3*c*, the second beams 20 may have already been moved back from the upper vertical position to the lower vertical position. This way, the product 100 may again be supported by the first beams 10 at the first position X2 along the conveying direction (arrow A) that now corresponds to a first position Y2 along the first beams (arrow B). The first position Y2 along the first beams is different than the initial position Y1 along the first beams, the first position Y2 lying closer to a downstream end 105 of the first beams 10 than the initial position Y1.

At this stage, a further product (or products) 100' may be provided on the first beams 10 substantially upstream from the product 100 already in the first position Y2 along the first beams 10. The further product 100' may e.g. be provided at the initial position Y1 along the first beams 10 (arrow B) and the same sequence substantially as explained in connection with FIGS. 3*a*-3*c* may be repeated. In alternatives, the further product may be provided after two, three or more strokes (back-and-forth reciprocating motion) of the first beams. The products may be identical or different.

Figure 3D:
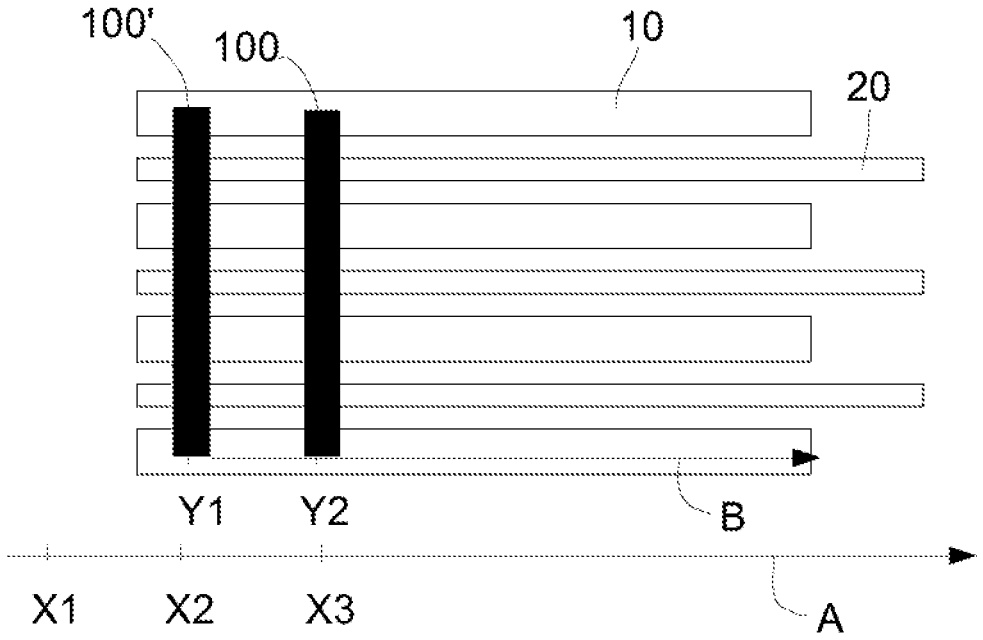

At FIG. 3*d*, the first beams 10 with the product 100 at the first position Y2 with respect to the first beams 10 and the further product 100' at the initial position Y1 with respect to the first beams 10 may have already been moved from the upstream position to the downstream position. This way, the product 100 may reach a second position X3 along the conveying direction (arrow A) while maintaining the first position Y2 with respect to the first beams (arrow 8). In those examples, in which a further product 100' is further provided at the initial position Y1 with respect to the first beams 10, the further product 100' may also be moved supported by the first beams 10 as the product 100 but from the initial position X1 along the conveying direction to e.g. the first position X2 along the conveying direction (arrow A) while maintaining the initial position Y1 along the first beams 10.

A sequence substantially as hereinbefore described may be repeated until the products (or batch of products) moves along the entire length of the first beams. This way, provided a further product is always provided after one or more strokes (back-and-forth reciprocating motion) of the first beams, a continuous (including semi-continuous) flow of heated products may be provided at an exit of the conveyor unit housed inside the furnace. In examples, the products may be left inside the furnace a predefined time in order to provide further heating to the products (batch of products). In these cases, a semi-continuous flow of heated products, i.e. a batch of products is provided.

In all examples, the stroke speed and/or the acceleration-deceleration of the movement of the first beams may be set in accordance with the size of the furnace, the thermal cycle to be performed, and the input requirements of the equipment fed by the furnace. Furthermore, control system which may typically be a combination of hardware and software may also be provided to regulate the speed at which the products move forward and/or the time the conveyor unit is stopped, e.g. in case a batch of products needs to stay inside the furnace longer.

In circumstances, depending on the relative length of the first and second beams, when a downstream end of the first beams is reached by a product, i.e. a last position along the conveying direction, a further step involving moving the second beams supporting the product from the upper vertical position to the lower vertical position such that the product remains supported by the second beams, at the last position along the conveying direction may be foreseen. In these cases, a still further step may involve moving the first beams from the upstream position to the downstream position so as to push the product supported by the second beams, from the last position along the conveying direction to an end position along the conveying direction. In these examples, such a pushing movement may be used e.g. for transferring of the products from e.g. the furnace to e.g. a press system. Alternatively, at the end position of the products a robot, e.g. a transportation fork or any other known holding unit may be provided for taking the heated products and moving them to the next process.

In examples, a holding unit, robot or fork may be provided at the beginning of the conveyor unit for providing the products in the initial position.

In order to provide a continuous flow of heated products (e.g. blanks), i.e. able to timely feed a continuous process such as e.g. a press system with the heated products, one or more conveyor units substantially as hereinbefore described may be provided inside the furnace. This way, the products may be moved inside the furnace by repeating a sequence substantially as explained in connection with FIGS. 3*a*-3*d* as necessary as a function of a length of the furnace which may depend, in turn, on the time the products need to be subjected to the temperature of the furnace.

Figure 4A:
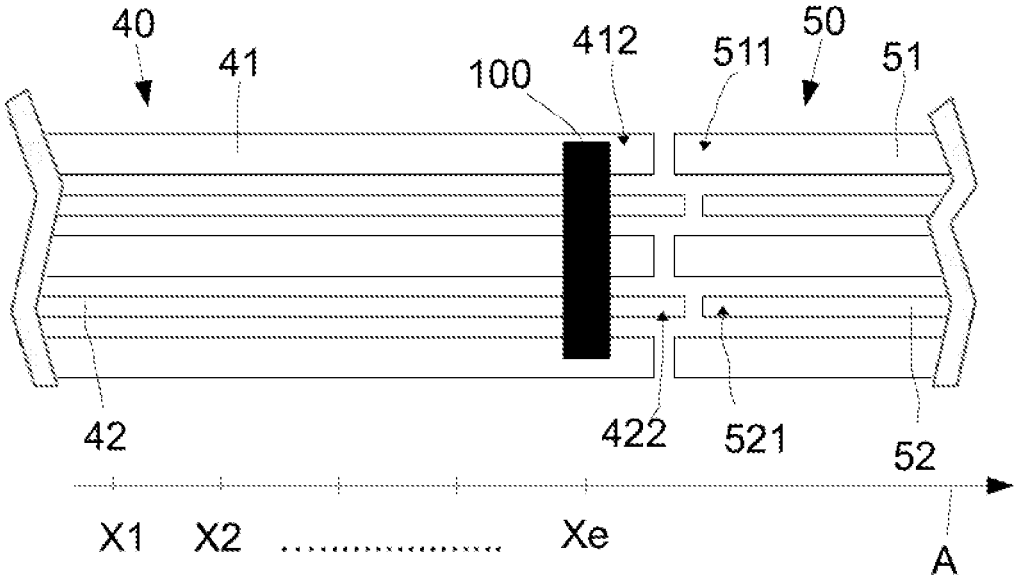
FIGS. 4*a* and 4*b* schematically show how two conveyor units can be put together to build a longer conveyor system.
Figure 4B:
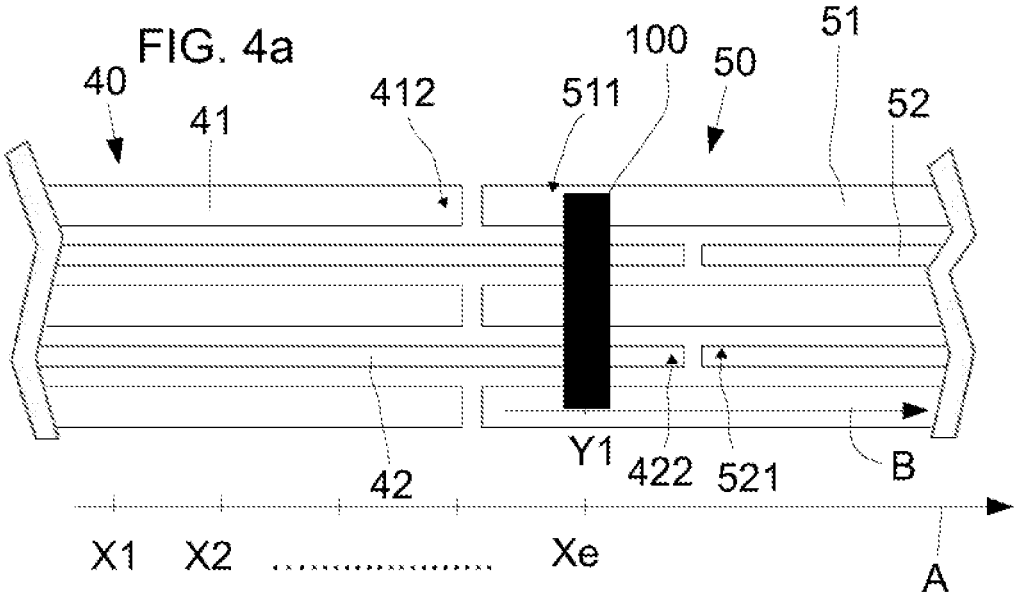

FIGS. 4*a* and 4*b* schematically show a partial top view of two conveyor units consecutively arranged so as to build a larger conveyor system. In more examples, more conveyor units may be foreseen. Each conveyor unit may be made and performed substantially as explained in connection with FIGS. 1-3*d*.

In the example of FIGS. 4*a* and 4*b* an upstream conveyor unit 40 and a downstream conveyor unit 50 are shown. Each unit 40, 50 may comprise first horizontally moving beams 41, 51 and second vertically moving beams 42, 52 substantially as hereinbefore described. A downstream end 412, 422 of the first 41 and second 42 beams of the upstream unit 40 may respectively abut an upstream end 511, 521 of the first 51 and second 52 beams of the downstream unit 50.

In this example, the first beams 41, 51 may move in unison and the second beams 42, 52 may move in unison. In some examples, the horizontally moving beams of a first unit may be connected by means of any known mechanical, hydraulic, or electronic system with the horizontally moving beams of a second unit in order to ensure that the moving beams of different conveyor units move in unison.

As further shown in FIGS. 4*a* and 4*b*, a sequence describing how a product 100 may be moved/transferred from the upstream unit 40 to the downstream unit 50 is schematically described.

In FIG. 4*a*, a product 100 is already at a downstream end 412 of the first beams 41. The first beams 41, 51 of both units 40, 50 may e.g. be at the downstream position. Thus, the product 100 may be at a downstream end position Xe along the conveying direction (arrow A) of the first beams 41 of the upstream unit 40. In FIG. 4*b*, the following steps may have already been carried out in the mean time: the second beams 42, 52 may have been moved from the lower vertical position to the upper vertical position, the first beams 41, 51 may have been moved back from the downstream position to the upstream position and the second beams 42, 52 may have further been moved back from the upper vertical position to the lower vertical position. This way, the product 100 may now be supported on the first beams 51 of the downstream unit 50, at an upstream end 511 thereof corresponding to the initial position Y1 along the first beams 51 of the downstream unit 50 and while maintaining the Xe position along the conveying direction (arrow A).

In some of these examples, the second beams of consecutive conveyor units, e.g. second beams 42 and 52 of units 40 and 50 of FIGS. 4*a* and 4*b* may be supported by the same support (reference 201 of FIG. 1). This way, a downstream end 422 of the second beams 42 of an upstream conveyor unit 40 and an upstream end 521 of the second beams 52 of a downstream conveyor unit 50 may be supported by a support as that shown with reference 201 in FIG. 1. In some examples, the support may be a T-shaped support. The provision of a single support contributes to moving the second beams of consecutive conveyor units in unison.

In alternative examples, the first beams (moving horizontally) of consecutive conveyor units may be interleaved along a part of their length and move in unison.

In some processes, for example hot forming, continuous furnaces may have an overall length ranging from approximately 35 to approximately 50 meters. In these examples, the furnace may comprise a plurality of conveyor units having a length ranging from approximately 5 to 10 meters. Thus, continuous furnace s may, in general be made from e.g. four to ten conveyor units consecutively arranged so as to build a larger conveyor system substantially as hereinbefore described. Other number of units consecutively arranged may also be foreseen.

In all examples, the products may be made of aluminium or steel, particularly an Ultra High Strength Steel (UHSS).

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A conveyor unit system for moving products in a conveying direction through a furnace, the unit system comprising:

a plurality of first elongated beams extending along the conveying direction and arranged substantially parallel to each other, wherein the first beams are slidably mounted on rollers and are constrained to be only displaceable in a back-and-forth reciprocating motion along the conveying direction between an upstream position and a downstream position, a plurality of second elongated beams extending along the conveying direction and arranged interleaved with the first beams, wherein the second beams are constrained to be only displaceable in an up-and-down reciprocating motion between a lower vertical position and an upper vertical position along a vertical direction that is defined in a plane substantially perpendicular to a plane of the conveying direction, wherein an upper working surface of the first beams that in use supports the products is positioned along the vertical direction, between the lower vertical position and the upper vertical position, wherein the rollers are defined by outer protrusions circumferentially provided on one or more rotatable shafts, the shafts being arranged substantially transversally to the first beams, and wherein the first beams comprise an inverted U-shaped cross-section or an H-shaped cross-section in which the outer protrusions of the rollers are housed so as to protect the outer protrusions of the rollers from contaminants falling from the products.

2. The system of claim 1, further comprising a driving mechanism for providing a linear back-and-forth reciprocating motion to the first beams.

3. The system of claim 1, further comprising a motor drive for rotating one or more of the rollers.

4. The system of claim 1, further comprising a driving mechanism for providing a linear up-and-down reciprocating motion to the second beams.

5. A method of moving products in a conveying direction through the conveyor unit system of claim 1, wherein the method comprises providing the first beams in the upstream position and the second beams in the lower vertical position; the method further comprising:

a) providing one or more products on the first beams at an initial position along the conveying direction corresponding to an initial position along the first beams;

b) moving the first beams from the upstream position to the downstream position such that the one or more products reach a first position along the conveying direction while maintaining the initial position with respect to the first beams;

c) moving the second beams from the lower vertical position to the upper vertical position such that the one or more products are supported by the second beams, at the first position along the conveying direction;

d) moving the first beams from the downstream position to the upstream position; and e) moving the second beams from the upper vertical position to the lower vertical position such that the one or more products are supported by the first beams, at the first position along the conveying direction which corresponds to a first position along the first beams that is different than the initial position along the first beams.

6. The method of claim 5, further comprising f) moving the first beams with the one or more products at the first position with respect to the first beams from the upstream position to the downstream position such that the one or more products reach a second position along the conveying direction while maintaining the first position with respect to the first beams;

g) moving the second beams from the lower vertical position to the upper vertical position such that the one or more products are supported by the second beams, at the second position along the conveying direction;

h) moving the first beams from the downstream position to the upstream position; and i) moving the second beams from the upper vertical position to the lower vertical position such that the one or more products are supported by the first beams, at the second position along the conveying direction which corresponds to a second position along the first beams that is different than the first position along the first beams; and optionally repeating steps f) to i).

7. The method of claim 6, further comprising after step h)

j) moving the second beams from the upper vertical position to a down position such that the one or more products remain supported by the second beams, at the second position along the conveying direction; and k) moving the first beams from the upstream position to the downstream position so as to push the one or more products held by the second beams, from the second position along the conveying direction to a third position along the conveying direction.

8. A continuous furnace comprising the conveyor unit system according to any of claims 5-7 for moving products in the conveying direction with the method of any of claims 5-7.

9. The continuous furnace of claim 8, comprising two or more of the conveyor unit systems for moving the products in the conveying direction, wherein the first beams of the two or more conveyor unit systems move in unison and the second beams of the two or more conveyor unit systems move in unison.

10. The continuous furnace of claim 9, wherein the first beams of a downstream conveyor unit system at an upstream position are partially interleaved with the second beams of an upstream conveyor unit system.

11. The continuous furnace of claim 9, wherein the first beams of an upstream conveyor unit system at a downstream position are partially interleaved with the second beams of a downstream conveyor unit system.

12. The continuous furnace of claim 9, wherein a path defined by the first beams of an upstream conveyor unit system substantially overlaps with a path defined by the first beams of a downstream conveyor unit system.

13. The continuous furnace of claim 9, wherein at any of steps e) or i) when the second beams are moved from the upper vertical position to the lower vertical position the products are supported by the first beams of a downstream conveyor unit system.

* * * * *